US006344841B1

(12) United States Patent
Moon

(10) Patent No.: US 6,344,841 B1
(45) Date of Patent: Feb. 5, 2002

(54) METHOD FOR DRIVING A PLASMA DISPLAY PANEL HAVING MULTIPLE DRIVERS FOR ODD AND EVEN NUMBERED ELECTRODE LINES

(75) Inventor: Seong Hak Moon, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/346,299

(22) Filed: Jul. 2, 1999

(30) Foreign Application Priority Data

Jul. 4, 1998 (KR) ..... 98-27018

(51) Int. Cl.[7] ..... G09G 3/28

(52) U.S. Cl. ..... 345/60; 345/67; 345/68; 315/169.4

(58) Field of Search ..... 345/60–69; 315/169.1, 315/169.4

(56) References Cited

U.S. PATENT DOCUMENTS 5,867,135 A * 2/1999 Salavin et al. ..... 345/68
6,002,381 A * 12/1999 Tomio et al. ..... 345/60
6,072,447 A * 6/2000 Noborio ..... 345/60
6,091,380 A * 7/2000 Hashimoto et al. ..... 345/60
6,160,529 A * 12/2000 Asao et al. ..... 345/60

FOREIGN PATENT DOCUMENTS

KR 97-12896 3/1997
KR 97-51718 3/1997

* cited by examiner

*Primary Examiner*—Almis R. Jankus
*Assistant Examiner*—Amr Awad
(74) *Attorney, Agent, or Firm*—Fleshner & Kim, LLP

(57) ABSTRACT

A plasma display panel driving apparatus is disclosed. In the apparatus, a number of cells are formed by a plurality of electrode lines defined on a substrate in a matrix pattern. The electrode lines is provided with scanning and sustaining electrodes for selectively scanning and sustaining the cells for each line. An electrode driver divides the scanning and sustaining electrodes into at least two to drive them.

2 Claims, 13 Drawing Sheets

METHOD FOR DRIVING A PLASMA DISPLAY PANEL HAVING MULTIPLE DRIVERS FOR ODD AND EVEN NUMBERED ELECTRODE LINES

BACKGROUND OF THE INVENTION

1. Field of the Invention

This invention relates to a flat panel display device, and more particularly to a method of driving a plasma display panel(PDP) for displaying a picture and an apparatus thereof.

2. Description of the Related Art

Nowadays, there have been actively developed a flat panel display device such as a liquid crystal display(LCD) device, a field emission display device, a plasma display device and so on. The flat panel display device displaying a picture making use of a discharge has been highlighted due to its simple structure and the easiness in manufacturing it. Also, the plasma display device provides a high brightness, a high radiation efficiency, an improved memory ability and a wide view angle of more than 16°. Furthermore, the plasma display device has an advantage in that it can implement a large screen of more than 40 inches. Such a plasma display device is classified into a direct current(DC) system and an alternating current(AC) system depending on a discharge generation type. The alternating current system of plasma display device has been noticed because a consumption power is low and a lifetime is long compared with the direct current system.

Since the plasma display device has a characteristic in that its brightness becomes different in accordance with a discharge time of each cell, it must control a discharge time of each pixel in one field interval(e.g., 16.67 ms in the case of an image signal of NTSC system) of a single image signal so as to display a moving picture having a gray scale. The driving apparatus of AC system displaying a picture depending on the discharge interval includes a plasma display panel(PDP) driving apparatus as shown in FIG. 1. The PDP driving apparatus of FIG. 1 includes a scanning/sustaining electrode driver 2, a common sustaining electrode driver 4 and first and second address electrode drivers 6A and 6B, which are connected to a PDP 8. The PDP 8 is provided with scanning/sustaining electrodes Y1 to Yn and common sustaining electrodes Z1 to Zn which are alternately arranged in the vertical direction, and address electrodes X1 to Xm arranged, in parallel, in the horizontal direction. In the PDP 8, mxn pixels are formed in a matrix pattern in such a manner to be connected to the scanning/sustaining electrodes(Y), the common sustaining electrodes(Z) and the address electrodes (X). The scanning/sustaining electrode driver 2 allows pixels to be discharged to be sequentially selected in the line unit and a discharge in each of the mxn pixels to be sustained. To this end, as shown in FIG. 2, the scanning/sustaining electrode driver 2 performs a reset operation for make a uniformity of the cells by a writing and erasing operation on the entire cells, an addressing operation of allowing the pixels to selectively initiate a discharge, and a sustaining operation of allowing a discharge of the pixels to be sustained. The scanning/sustaining electrode driver 2 applies writing and erasing pulses to the scanning/sustaining electrodes Y1 to Yn in a reset interval, applies a scanning pulse to the scanning/sustaining electrodes Y1 to Yn sequentially in an addressing interval, and applies a sustaining pulse to the scanning/sustaining electrodes Y1 to Yn in a sustaining interval. Also, the scanning/sustaining electrode driver 2 may additionally supplies a writing pulse to the scanning/sustaining electrodes Y1 to Yn in the reset interval to form a wall charge at each of the mxn pixels. The common sustaining electrode driver 4 applies a predetermined level of voltage signal to all the common sustaining electrodes Z1 to Zn. The first and second address electrode drivers 6A and 6B supply an image data to the address electrodes X1 to Xm in the PDP 8 in such a manner that the image data is synchronized with the scanning pulse. The first address electrode driver 6A supplies an image data to odd-numbered address electrodes X1, X3, . . . , Xm-3, Xm-1 while the second address electrode driver 6B supplies an image data to even-numbered address electrodes X2, X4, . . . , Xm-2, Xm.

Further, the plasma display device controls a light quantity depending on the discharge time to realize a gray level. In other words, in the plasma display device, the discharge time is controlled such that a contrast and a chromaticity of the picture become different. To this end, as the plasma display device of AC system is used a PDP driving technique of address display separated (ADS) system. In this PDP driving technique of ADS system, a single field is divided into a number of sub-fields in accordance with a gray level intended to be implemented, and each sub-field is divided into an addressing interval and a sustaining interval to drive the PDP 8. For instance, when it is intended to realize 256 gray levels, a field interval corresponding to 1/60 second is divided into 8 sub-fields SF1 to SF8 as shown in FIG. 3. Also, each of the 8 sub-fields SF1 to SF8 is again divided into an addressing interval and a sustaining interval. Each of pixels selected in the addressing interval indicated by oblique lines in FIG. 3 initiates a discharge. The discharge initiated at each of the selected pixels is sustained in a sustaining interval. The sustaining interval is lengthened by a interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$in accordance with the sub-fields. A brightness and a chrominance in each pixel are determined in accordance with a combination of the sub-fields SF1 to SF8.

In such PDP driving method of ADS system, a brightness of each pixel is determined by a sustaining interval. In other words, since the sustaining interval becomes more decreased as the address interval increases, a maximum value of the brightness displayed on the screen is lowered. For instance, it is assumed that one field interval of 16.67 ms is divided into 8 sub-fields(i.e., upon implementation of 256 gray scales) and a time of 3.6 $\mu$s is required to address a single pixel line. Also, assuming that 480 pixel lines has been formed in the PDP, when the scanning/sustaining electrodes Y1 to Yn are driven with a single scanning/sustaining driver 2 to scan a screen, a time of "480×3 $\mu$s=1.44 $\mu$s" is required to scan the entire 480 lines sequentially for each sub-field, and an addressing interval of 1.44 $\mu$s×8=11.52 $\mu$s is required for each field interval. In other words, an addressing interval of 11.52 $\mu$s is required to scan 480 pixel lines during one field. Accordingly, only 5.15 ms equal to 30% of 16.67 ms which is a time assigned to one field, is assigned to the sustaining interval. Also, since a reset interval for allowing all the cells to be in the same state by eliminating an affect of previous discharge at the inner side of the cell every sub-field must be included, the sustaining interval is shortened into, for example, 20 to 25%. Furthermore, since the number of pixel lines becomes more increased as a resolution of the PDP is heightened, the sustaining interval is more shortened. Also, the sustaining interval is more and more shortened as the PDP has a larger scale screen. Due to this, the conventional PDP driving method fails to brighten a screen into more than the limit. In addition, the conventional PDP driving method can assure the brightness of screen sufficiently as a resolution of the PDP becomes high or a screen of the PDP becomes large.

SUMMARY OF THE INVENTION

Accordingly, it is an object of the present invention to provide a plasma display panel driving method and apparatus that can improve the brightness of screen into more than the limit.

In order to achieve these and other objects of the invention, a plasma display panel driving apparatus according to one aspect of the present invention includes a plurality of cells formed by a plurality of electrode lines defined on a substrate in a matrix type, the electrode lines including scanning and sustaining electrodes for selectively scanning and sustaining said cells for each line; and an electrode driver for driving the scanning and sustaining electrodes with dividing them into more than two.

In a method of driving a plasma display panel according to another aspect of the present invention, scanning and sustaining discharge are driven such that at least one area performing a scanning operation and at least one area performing a sustaining discharge by sequentially scanning a plurality of lines exist within the same plasma panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
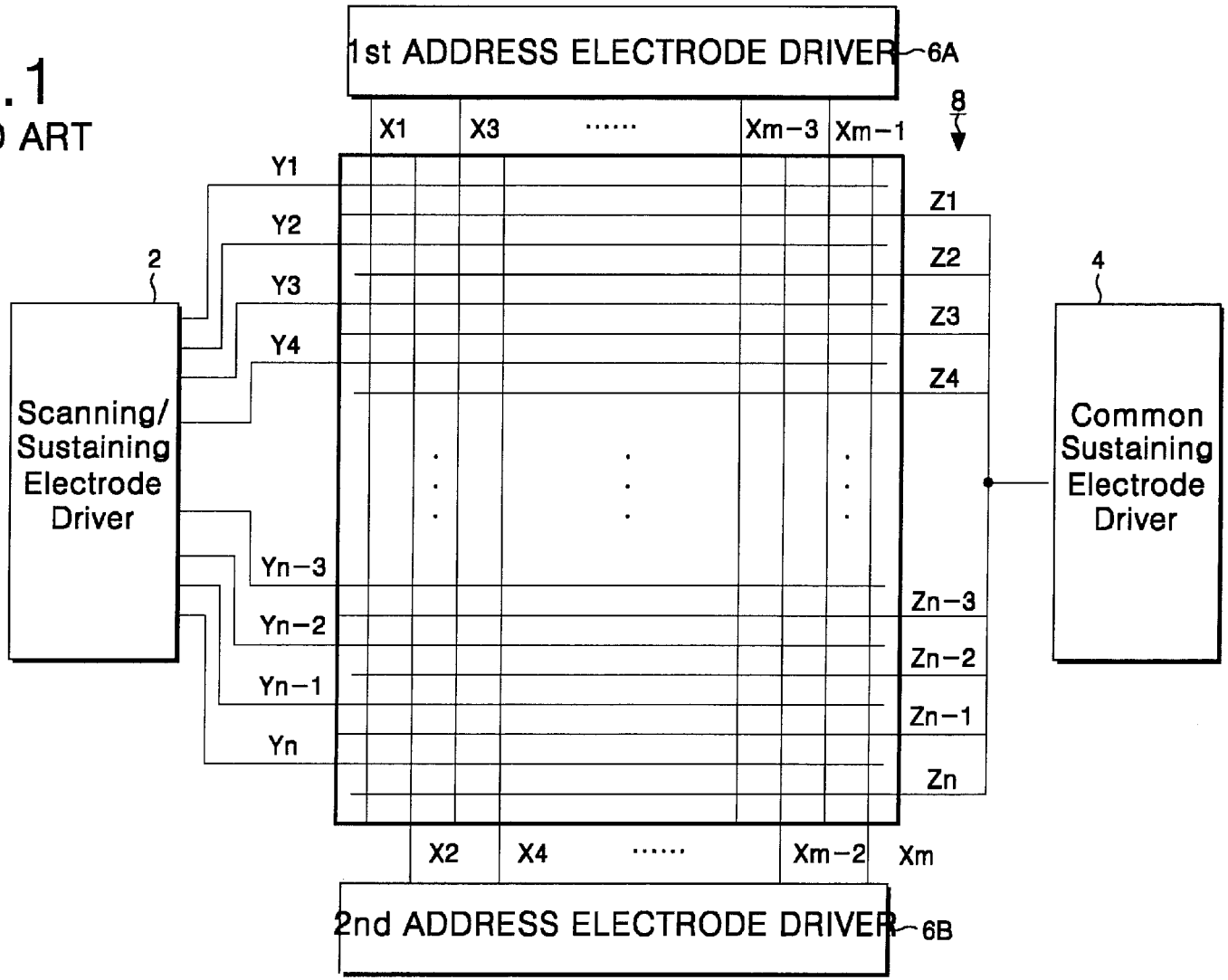
FIG. 1 RELATED ART
FIG. 1 is a schematic view showing the configuration of a conventional PDP driving apparatus.
Figure 2:
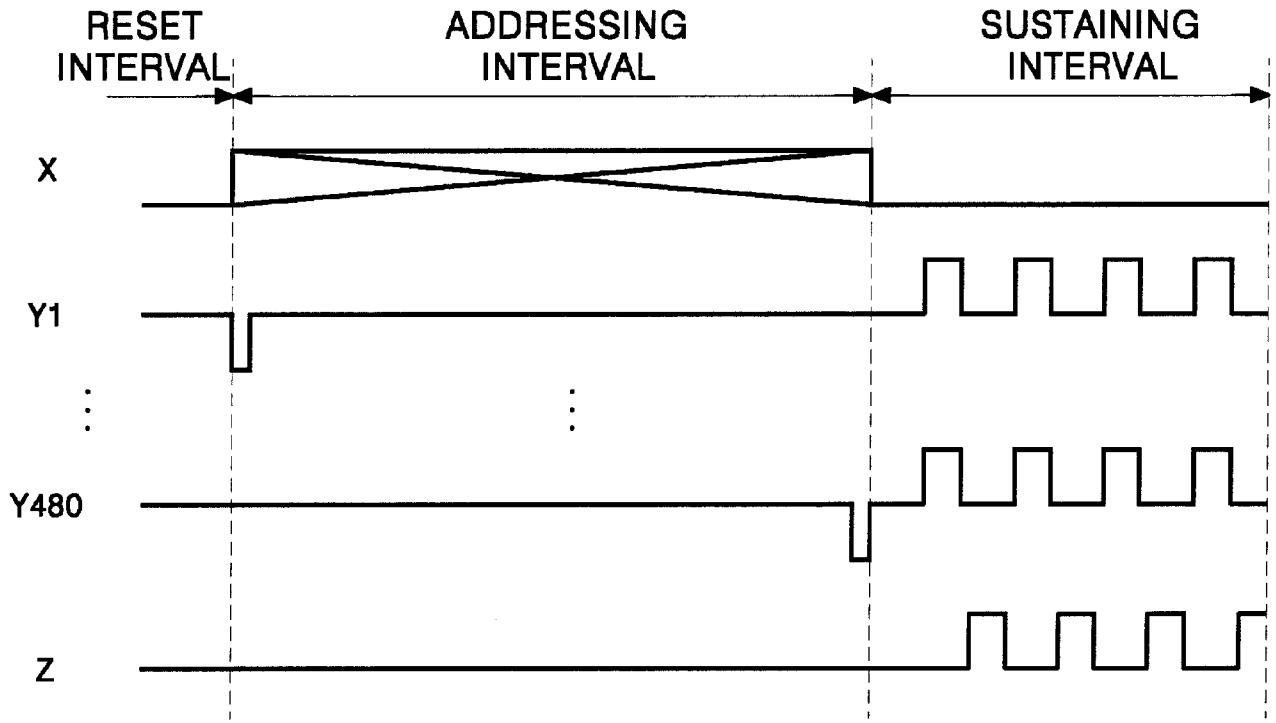
FIG.2 RELATED ART
FIG. 2 is a view for explaining the PDP driving method shown in FIG. 1.
Figure 3:
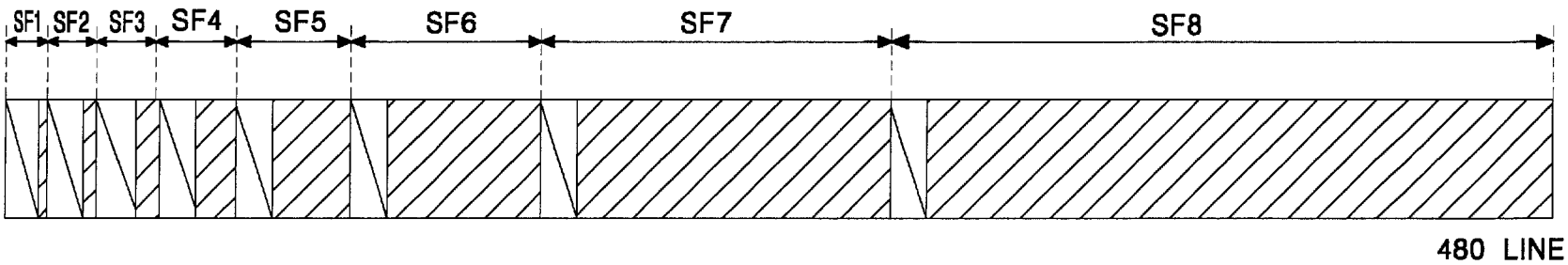
FIG.3 RELATED ART
FIG. 3 is a view for explaining a PDP driving method of ADS system.
Figure 4:
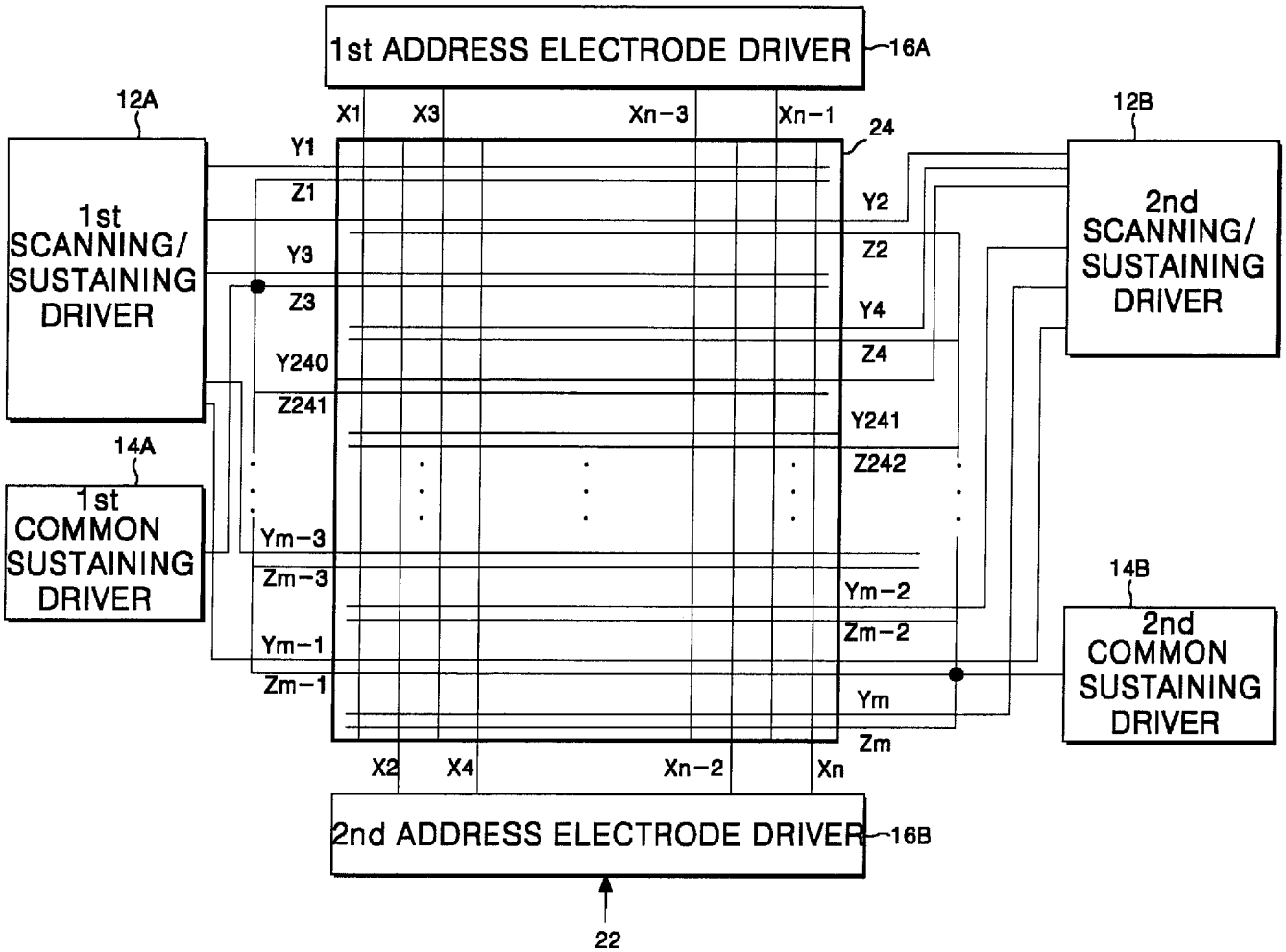
FIG. 4 is a schematic view showing the configuration of a PDP driving apparatus according to an embodiment of the present invention.

Referring to FIG. 4, there is shown a PDP driving apparatus according to an embodiment of the present invention. The PDP driving apparatus includes a PDP 24 provided with n address electrodes X1 to Xn, hereinafter referred to as "X electrode", m scanning/sustaining electrodes Y1 to Ym, hereinafter referred to as "Y electrode", and m common sustaining electrodes Z1 to Zm, hereinafter referred to as "Z electrode", a first scanning/sustaining driver 12A for driving odd-numbered Y electrode Y1, Y3, . . . , Ym-1, hereinafter referred to as "Yodd", a second scanning/sustaining driver 12B for driving even-numbered Y electrode Y2, Y4, . . . , Ym, hereinafter referred to as "Yeven", a first common sustaining driver 14A for driving odd-numbered Z electrode Z1, Z3, . . . , Zm-1, hereinafter referred to as "Zodd", a second common sustaining driver 14B for driving even-numbered Z electrode Z2, Z4, . . . , Zm, hereinafter referred to as "Zeven", a first address driver 16A for driving odd-numbered address electrodes X1, X3, . . . , Xn-1, hereinafter referred to as "Xodd", and a second address driver 16B for driving even-numbered address electrodes X2, X4, . . . , Xm, hereinafter referred to as "Xeven". The Y electrode Y1 to Ym and the Z electrode Z1 to Zm are arranged perpendicularly to the X electrode X1 to Xn. mxn pixels are formed at intersections among the Y electrode Y1 to Ym, the Z electrode Z1 to Zm and the X electrode X1 to Xn. The first scanning/sustaining driver 12A applies an erasing pulse to pixels of the odd-numbered Y electrode Yodd simultaneously every sub-field to eliminate an affect of previous discharge, and then applies a scanning pulse to pixels of the odd-numbered Y electrode Yodd to select pixels having a bit data inputted from the address electrodes X1 to Xn. A wall charge is formed within cells selected by this address discharge to cause a sustaining discharge by a low voltage applied from the first scanning/sustaining driver 12A and the first common sustaining driver 14A in the sustaining discharge interval. During the sustaining discharge, the first scanning/sustaining driver 12A and the first common sustaining driver 14A respond to a timing control signal to apply a sustaining pulse to the entire odd-numbered lines. The first common sustain driver 14A applies a different phase of sustaining pulse to the odd-numbered Z electrode Zodd simultaneously in a time interval when the sustaining pulse is outputted from the first scanning/sustaining driver 12A. The first scanning/sustaining driver 12A and the first common sustaining driver 14A are installed at the left side of the PDP 24. Likewise, the second scanning/sustaining driver 12B applies an erasing pulse to pixels of the even-numbered Y electrode Yeven simultaneously every sub-field to eliminate an affect of previous discharge, and then applies a scanning pulse to pixels of the even-numbered Y electrode Yeven to select pixels having a bit data inputted from the address electrodes X1 to Xn. A wall charge is formed within cells selected by this address discharge to cause a sustaining discharge by a low voltage applied from the second scanning/sustaining driver 12B and the second common sustaining driver 14B in the sustaining discharge interval. During the sustaining discharge, the second scanning/sustaining driver 12B and the second common sustaining driver 14B respond to a timing control signal to apply a sustaining pulse to the entire even-numbered lines. The second common sustaining driver 14B applies a different phase of sustaining pulse to the even-numbered Z electrode Zeven simultaneously in a time interval when the sustaining pulse is outputted from the second scanning/sustaining driver 12B. The second scanning/sustaining driver 12B and the second common sustaining driver 14B are installed at the right side of the PDP 24. The first address electrode driver 16A is connected to the odd-numbered X electrode Xodd while the second address electrode driver 16B is connected to the even-numbered X electrode Xeven. The first address electrode driver 16A inputs odd-numbered bit data to the odd-numbered X electrode Xodd and applies the odd-numbered bit data to each of the odd-numbered X electrode Xodd in a time interval when the scanning pulse is applied to the Y electrode Yodd and Yeven, thereby allowing odd-numbered pixels to initiate a sequential discharge for a single line. Each of the odd-numbered pixels selectively initiates a discharge in accordance with logical values of the odd-numbered bit data. In a similar manner, the second address electrode driver 16B inputs even-numbered bit data to the even-numbered X electrode Xeven and applies the even-numbered bit data to each of the even-numbered X electrode Xeven in a time interval when the scanning pulse is applied to the Y electrode Yodd and Yeven, thereby allowing even-numbered pixels to initiate a sequential discharge for a single line. Each of the even-numbered pixels selectively initiates a discharge in accordance with logical values of the even-numbered bit data. A time interval when the scanning pulse is applied to the odd-numbered Y electrode Yodd and a time interval when the scanning pulse is applied to the even-numbered Y electrode Yeven overlap with a portion of the sustaining interval of the corresponding Y electrode Yeven or Yodd.

Assuming that 480 pixel lines are formed in the PDP 24, the present invention terminates an address operation as long as only 240 odd-numbered lines or 240 even-numbered lines are scanned in comparison to the prior art terminating an address operation only when 480 pixel lines are sequentially scanned, so that it can shorten the addressing interval. Also, since the present invention independently performs the scanning and sustaining discharge of the odd-numbered lines and the even-numbered lines by means of the first scanning/sustaining driver 12A and the second scanning/sustaining driver 12B, it controls a timing to make a sustaining discharge of the even-numbered lines in the scanning interval of the odd-numbered line while controlling a timing to make a scanning interval of the even-numbered lines in a sustaining discharge interval of the odd-numbered lines. In other words, a sustaining discharge occurs in the even-numbered lines when 240 odd-numbered lines are scanned in one sub-field interval while a scanning operation occurs in the even-numbered lines when 240 odd-numbered lines are is sustaining-discharged. As a result, the sustaining discharge and the scanning operations in one sub-field interval. Accordingly, a scanning interval making an address being input is shortened into a half while a sustaining interval is lengthened, compared with the conventional PDP driving method of ADS system. Ultimately, a picture displayed on the PDP 24 is brightened.

Figure 5A:
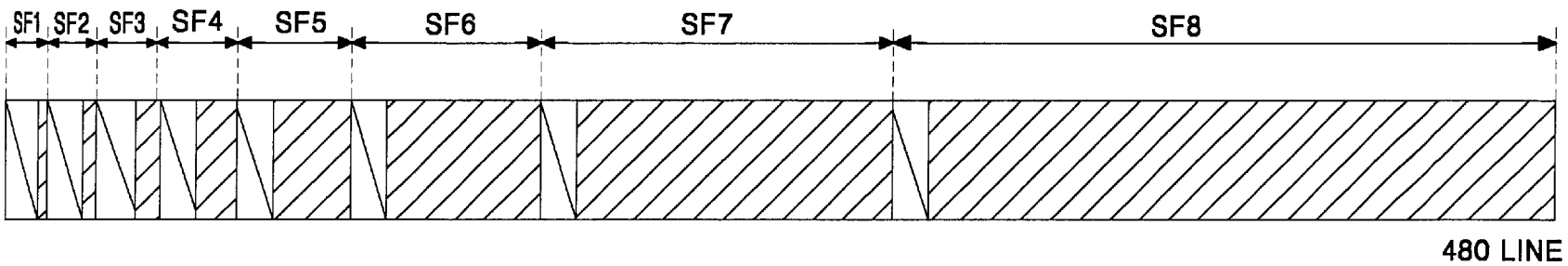
FIG. 5 is a view for comparing the conventional driving method of ADS system with a PDP driving method of ADS system according to an embodiment of the present invention.
Figure 5B:
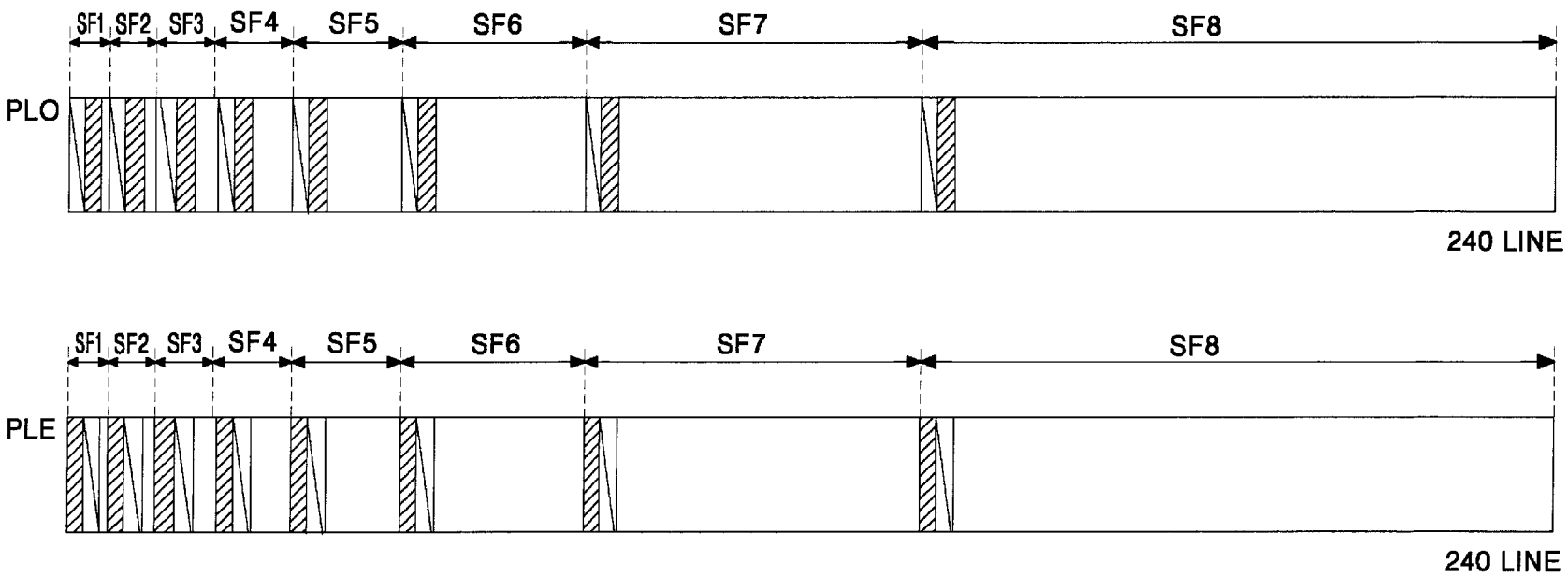

FIG. 5A explains the PDP driving method of conventional ADS system while FIG. 5B explains a tDP driving method of ADS system according to the present invention. Referring to FIGS. 5A and 5B, a single field is divided into 8 sub-fields SF1 to SF8, each of which is divided into an addressing interval and a sustaining interval. Also, FIG. 5A and FIG. 5B represent a timing at which the PDP provided with 480 pixel lines is driven during the field interval. In FIG. 5B, "PLO" explains a timing at which 240 odd-numbered pixel lines are driven during the field interval while "PLE" explains a timing at which 240 even-numbered pixel lines are driven during the field interval. In FIGS. 5A and 5B, regions indicated by oblique lines represent the addressing interval while the remaining regions represent the sustaining interval. It can be seen from FIG. 5A and 5B that an addressing interval in the PDP driving method of ADS system according to the present invention is reduced into a half compared with that in the PDP driving method of conventional ADS system. Moreover, the reduced addressing interval is used as a sustaining time, so that the entire time efficiency is improved more than twice.

Figure 6A:
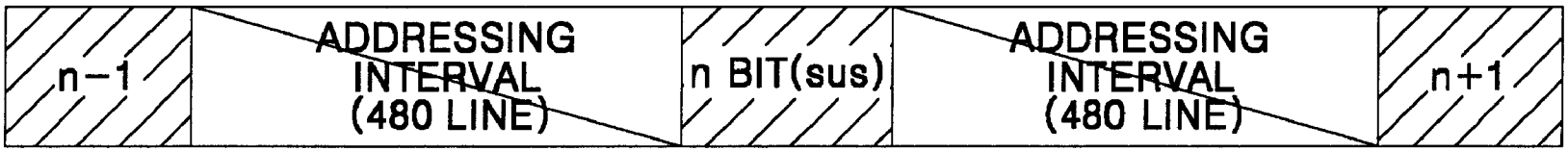
FIGS. 6A and 6B are detailed views for a portion of sub-field intervals in FIG. 1.
Figure 6B:
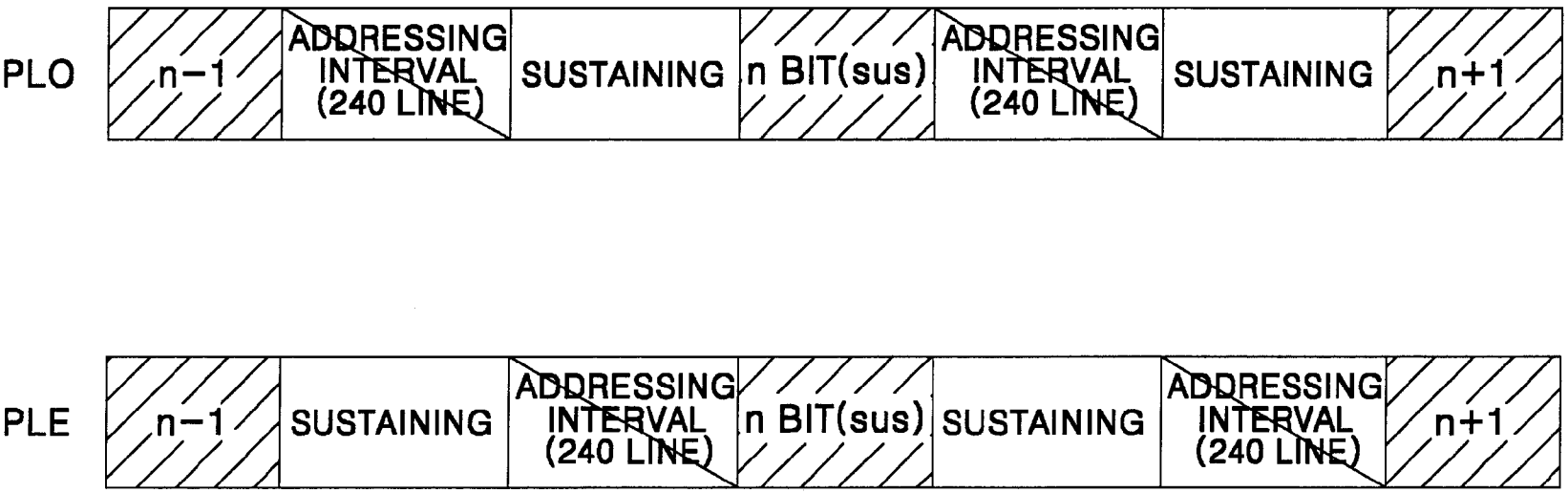

Such a fact will be more apparent from FIGS. 6A and 6B in which a portion of the intervals in FIGS. 5A and 5B is enlarged. Referring to FIG. 6A and FIG. 6B, the total addressing interval at which the entire screen is scanned by the PDP driving method of ADS system according to the present invention is equal to the addressing interval in the PDP driving method of conventional ADS system. However, since the odd-numbered pixel lines and the even-numbered pixel lines are divisionally driven, an addressing interval in each of the odd-numbered and even-numbered lines occupies a half of the total addressing interval. Further, the even-numbered pixel lines maintains a discharge when the odd-numbered pixel lines are addressed; while the odd-numbered pixel lines maintains a discharge when the even-numbered pixel lines are addressed. Accordingly, the sustaining interval of the odd-numbered pixel lines includes the second half of the addressing interval in the PDP driving method of conventional ADS system while the sustaining interval of the even-numbered pixel lines includes the first half of the addressing interval in the PDP driving method of conventional ADS system. For example, if an addressing interval of a single pixel line is 3 $\mu$s, then an addressing interval of the 240 odd-numbered pixel lines becomes 3 $\mu$s×240=0.7 ms. The 240 odd-numbered pixel lines consumes an addressing interval of 0.7 ms×8=5.6 ms so as to display a single picture, so that a sustaining interval of 16.67 ms−5.6 ms=11.07 ms can be obtained. Accordingly, the odd-numbered pixel lines assure a time of 11.07 ms corresponding to 66.4% of the field interval of 16.67 ms as their sustaining interval. Likewise, the 240 even-numbered pixel lines addressed in a time interval when the odd-numbered pixel lines maintains a discharge assure a time of 11.07 ms corresponding to 66.4% of the field interval. In other words, a sustaining interval in the PDP driving method of ADS system according to the present invention is lengthened by a time corresponding to a half of the addressing interval in the PDP driving method of conventional ADS system. In the PDP driving method of ADS system according to the present invention as described above, the addressing interval of the odd-numbered pixel lines and the addressing interval of the even-numbered pixel lines overlap with the sustaining interval of the even-numbered pixel lines and the sustaining interval of the odd-numbered pixel lines, respectively, and alternates with the sustaining interval of the odd-numbered pixel lines and the sustaining interval of the even-numbered pixel lines, respectively, thereby lengthening a sustaining interval of the pixel lines into more than twice the sustaining interval in the conventional PDP driving method. In other words, a ratio of utilizing a time with respect to the field interval in the PDP driving method of ADS system according to the present invention becomes more than twice of that in the PDP driving method of conventional ADS system. As a result, the PDP driving method of ADS system according to the present invention provides a picture having an improved brightness and an improved contrast.

Figure 7:
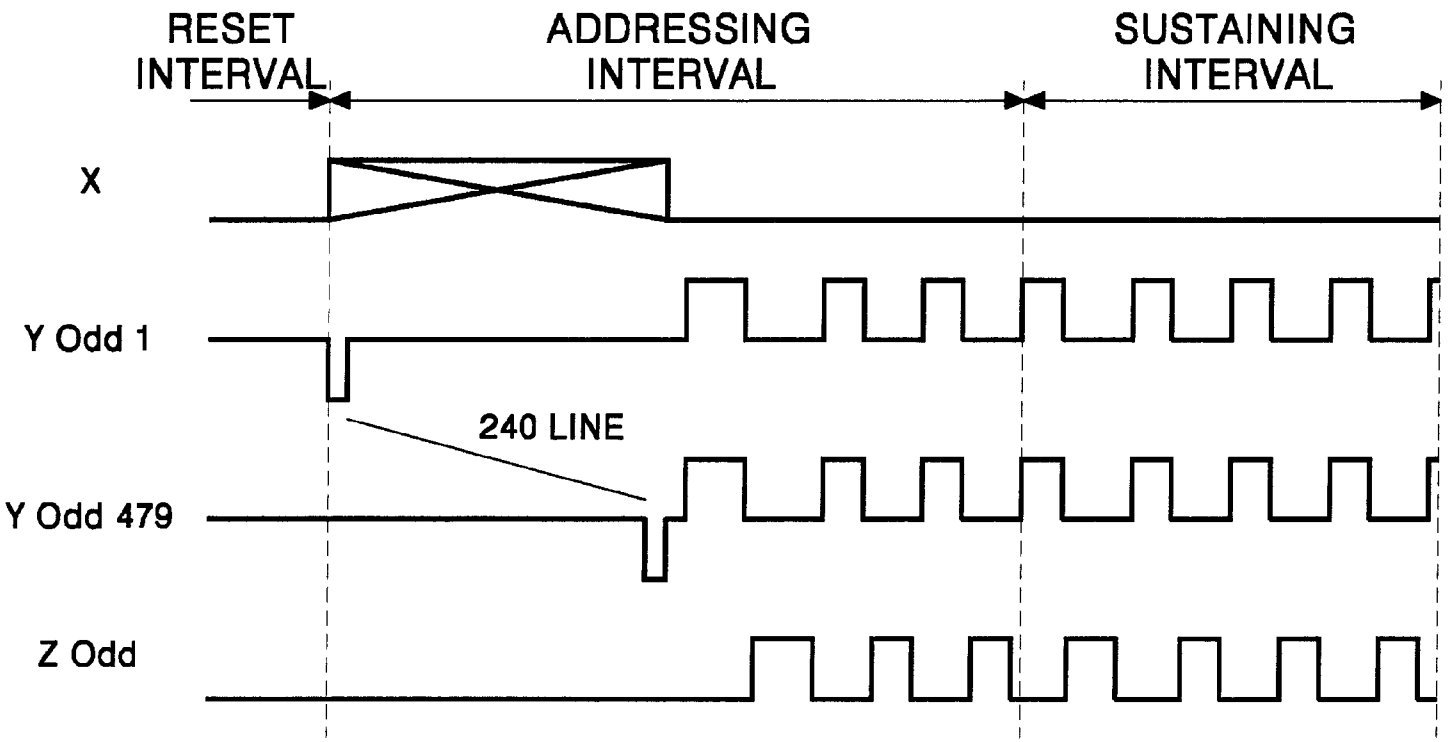
FIG. 7 is waveform diagrams of signals of ADS system provided for the odd-numbered pixel lines in the PDP shown in FIG. 3.

FIG. 7 shows a timing of signals applied to the PDP 24 for driving odd-numbered pixel lines in the PDP 24 shown in FIG. 4. In FIG. 7, Y1 to Y479 represent signals applied to each of the 240 odd-numbered Y electrodes Yodd; X does a start point at which an address is applied to X electrode X1 to Xm; and Z does signals applied to each of the 240 odd-numbered Z electrodes Zodd. Referring to FIG. 7, in the first half of the addressing interval, a scanning pulse is sequentially supplied to the odd-numbered Y electrodes Y1, Y3, . . . , Yn-3, Yn-1 and a data per sub-field is applied to the X electrode X1 to Xn. Accordingly, 240 odd-numbered pixel lines is sequentially addressed in the first half of the addressing interval. In other words, the addressing interval selectively initiates a discharge during the first-half interval of the conventional addressing interval and terminates an addressing. Subsequently, a sustaining pulse is commonly applied to the 240 odd-numbered Y electrodes Y1, Y3, . . . , Yn-3, Yn-1 from the next half interval of the conventional addressing interval, and a different phase of sustaining pulse is commonly applied to the 240 odd-numbered Z electrodes Z1, Z3, . . . , Zn-3, Zn-1 from the second half of the addressing interval. The odd-numbered pixel lines sustain a discharge in a time interval when the sustain pulses are applied.

Figure 8:
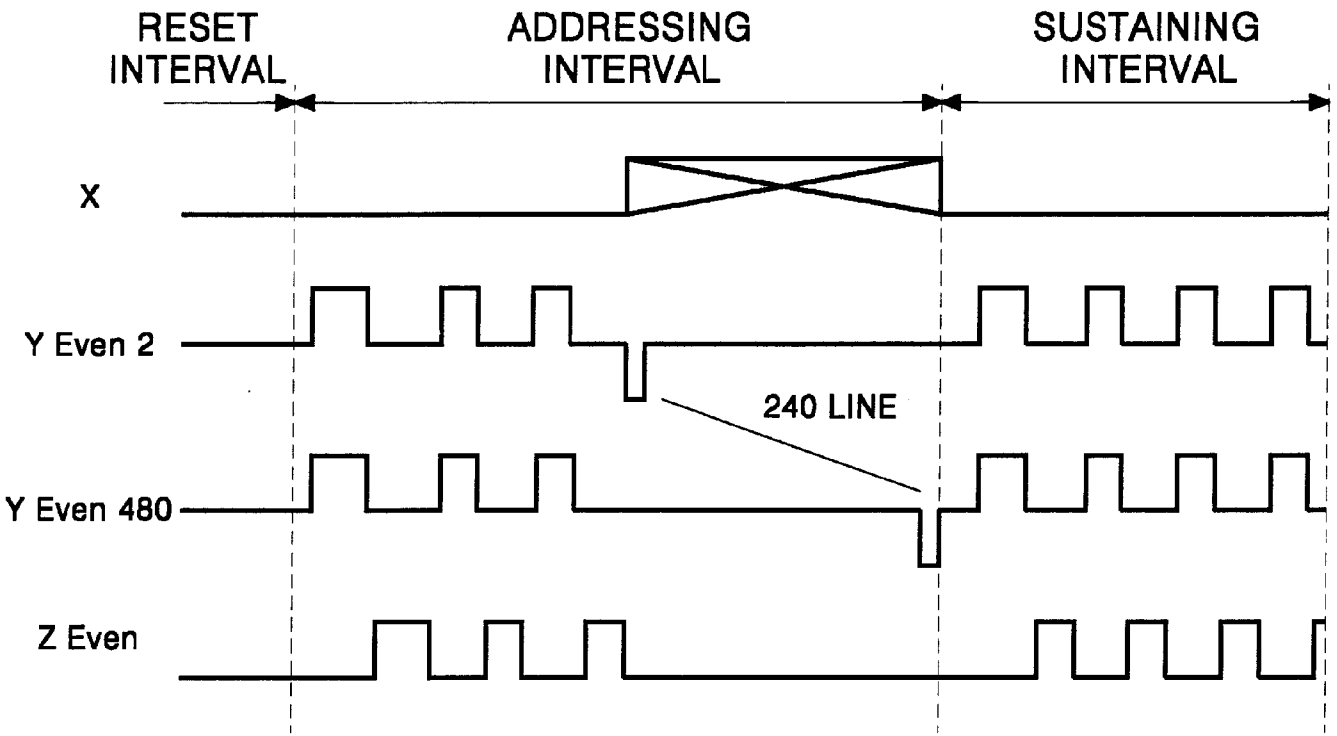
FIG. 8 is waveform diagrams of signals of ADS system provided for the even-numbered pixel lines in the PDP shown in FIG. 3.

FIG. 8 shows a timing of signals applied to the PDP 24 for driving even-numbered pixel lines in the PDP 24 shown in FIG. 4. In FIG. 8, Y2 to Y480 represent signals applied to each of the 240 even-numbered Y electrodes Yeven. X represents a start point at which an address is applied to each of the X electrode X1 to Xm, and Z does signals applied to each of the 240 even-numbered Z electrodes. Referring to FIG. 8, in the second half of the addressing interval, a scanning pulse is sequentially applied to the even-numbered Y electrodes Y2, Y4, . . . , Yn-2, Yn, and a data field is applied to the X electrode X1 to Xm. Accordingly, the 240 even-numbered pixel lines is selectively addressed in the second half of the addressing interval. In other words, the 240 even-numbered pixel lines selectively initiate a discharge in the first half of the addressing interval. Subsequently, the sustaining pulse is commonly applied to the 240 even-numbered Y electrodes Y2, Y4, . . . , Yn-2, Yn in a time interval from a start point of the addressing interval until the first half of the addressing interval, and a different phase of sustaining pulse is commonly applied to the 240 even-numbered Z electrodes Z2, Z4, . . . , Zn-2, Zn. The even-numbered pixel lines sustain a discharge in a time interval when the sustain pulses are applied.

In the present invention, since the Z electrodes are separated into odd-numbered Z electrodes Zodd and even-numbered Z electrodes Zeven which are driven with the first common sustaining driver 14A and the second common sustaining driver 14B installed at the opposite side around the PDP 24, direction of currents applied to the odd-numbered lines becomes contrary to that applied to the even-numbered lines. This will be described in detail in conjunction with FIG. 9.

Figure 9:
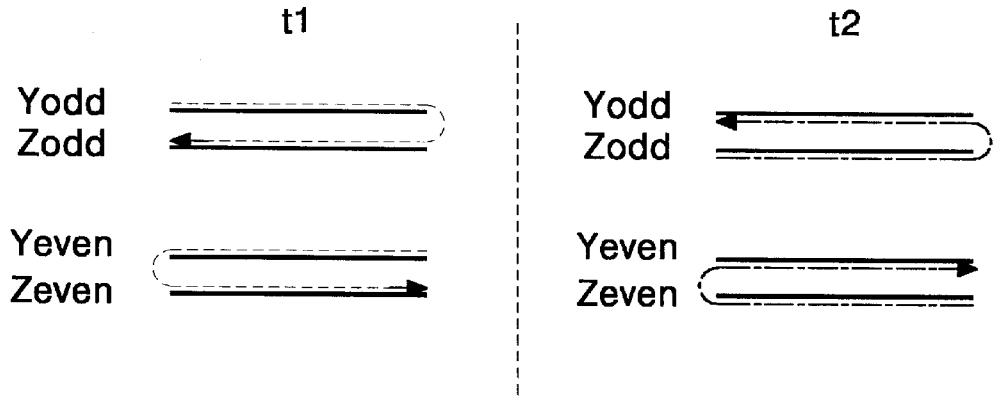
FIG. 9 shows direction of currents flowing in the scanning/sustaining electrodes and the common sustaining electrodes shown in FIG. 3.

Referring now to FIG. 9, in a time interval of t1, a current applied to the odd-numbered sustaining electrode pair progresses from the left stage of the odd-numbered Y electrode Yodd, via the right stage of the odd-numbered Y electrode Yodd and the right stage of the odd-numbered Z electrode Zodd, into the left stage of the odd-numbered Z electrode Zodd, whereas a current applied to the even-numbered sustaining electrode pair progresses from the right stage of the even-numbered Y electrode Yeven, via the left stage of the even-numbered Y electrode Yeven and the left stage of the even-numbered Z electrode Zeven, into the right stage of the even-numbered Z electrode Zeven. Otherwise, in a time interval of t2, a current applied to the odd-numbered sustaining electrode pair progresses from the left stage of the odd-numbered Z electrode Zodd, via the right stage of the odd-numbered Z electrode Zodd and the right stage of the odd-numbered Y electrode Yodd, into the left stage of the odd-numbered Y electrode Yodd, whereas a current applied to the even-numbered sustaining electrode pair progresses from the right stage of the even-numbered Z electrode Zeven, via the left stage of the even-numbered Y electrode Yeven and the left stage of the even-numbered Z electrode Zeven, into the right stage of the even-numbered Y electrode Yeven. In other words, the current flowing in the odd-numbered sustaining electrode pair and the current flowing in the even-numbered sustaining electrode pair progress in a direction contrary to each other. This results from the first scanning/sustaining driver 30A and the first common sustaining driver 32A for driving the odd-numbered sustaining electrode pair being located at the left sides of the Y and Z electrodes while the second scanning/sustaining driver 30B and the second common sustaining driver 32B for driving the even-numbered sustaining electrode pair being located at the right sides of the Y and Z electrodes. As described above, in the sustaining interval, the current in the odd-numbered sustaining electrode pair and the current in the even-numbered sustaining electrode pair flow in a direction opposite to each other. As a result, the PDP driving apparatus according to the present invention can reduce a current amount into less than ½ in comparison to the conventional PDP driving apparatus which allows currents flowing in each of the sustaining electrode pairs to be progressed in the same direction. Further, the PDP driving apparatus according to an embodiment of the present invention is capable of reducing an electromagnetic interference (EMI) in accordance with the reduction in the current amount.

Figure 10A:
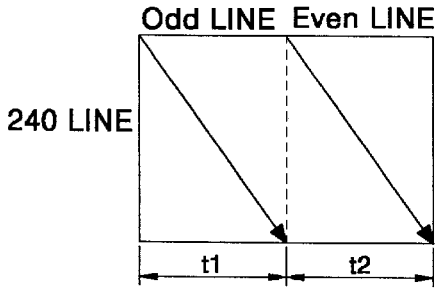
FIGS. 10A to 10E show examples of a scanning system according to the present invention.
Figure 10B:
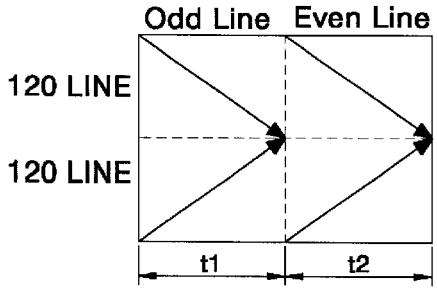
Figure 10C:
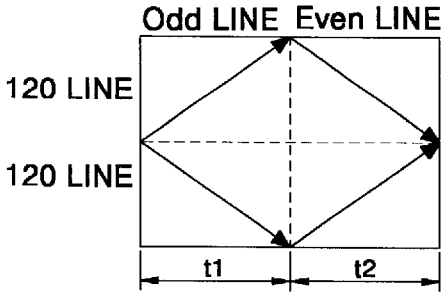
Figure 10D:
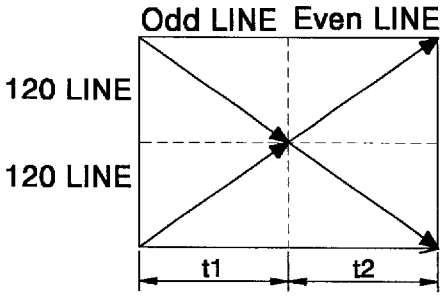
Figure 10E:
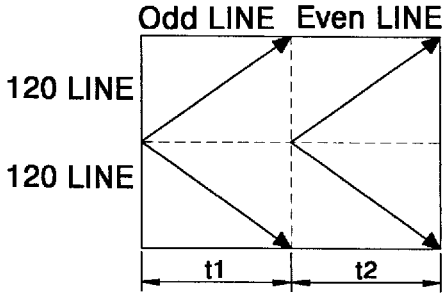

FIG. 10A to FIG. 10E shows various embodiment of a scanning system in the PDP driving method according to the present invention. In the present invention, when a panel divided into the odd-lines Yodd and the even-lines Yeven is scanned, a first scheme of scanning the odd-numbered lines during t1 and thereafter scanning the even-numbered lines during t2 and a second scheme of simultaneously scanning the odd-numbered and even-numbered lines with having a phase difference of one line may be used. Referring to FIG. 10A, the odd-numbered lines are sequentially scanned from the first line(i.e., Y1) until the 479th line(i.e., Y479) during t1, and thereafter the even-numbered lines are sequentially scanned from the second line(i.e., Y2) until the 480th line(i.e., Y480) during t2. Referring to FIG. 10B, after two upper and lower lines in the two-divisional odd-numbered lines were sequentially scanned from the 1st line/479th line until the 239th line/241st line during t1, two upper and lower lines in the two-divisional even-numbered lines are sequentially scanned from the 2nd line/480th line until the 2nd line/242nd line during t2. Referring to FIG. 10C, after two upper and lower lines in the two-divisional odd-numbered lines were sequentially scanned from the 239th line/241st line until the 1st line/479th line during t1, two upper and lower lines in the two-divisional even-numbered lines is sequentially scanned from the 2nd line/480th line until the 240th line/242st line during t2. Referring to FIG. 10D, after two upper and lower lines in the two-divisional odd-numbered lines were sequentially scanned from the 1st line/479th line until the 239th line/241st line during t1, two upper and lower lines in the two-divisional even-numbered lines are sequentially scanned from the 240th line/242nd line until the 2nd line/480th line during t2. Referring to FIG. 10E, after two upper and lower lines in the two-divisional odd-numbered lines were sequentially scanned from the 239th line/241st line until the 1st line/479th line during t1, two upper and lower lines in the two-divisional even-numbered lines are sequentially scanned from the 240th line/242nd line until the 2nd line/480th line during t2.

As described above, in the PDP driving apparatus according to the present invention, an addressing of the odd-numbered pixel lines is performed in a sustaining interval of the even-numbered pixel lines and an addressing of the even-numbered pixel lines is performed in a sustaining interval of the odd-numbered pixel lines. Also, an addressing of the odd-numbered pixel lines and the sustaining operation is alternated, and an addressing of the even-numbered pixel lines and the sustaining operation also is alternated. Accordingly, the PDP driving apparatus according to the present invention lengthens the sustaining interval. As a result, the PDP driving apparatus provides a picture with an improved brightness and an improved contrast. Further, in the PDP driving apparatus according to the present invention, the odd-numbered pixel lines and the even-numbered pixel lines are driven each electrode driver to reduce a power consumption. Moreover, a current in the odd-numbered pixel line flows in a direction different from a current in the even-numbered pixel line(i.e., in a direction contrary thereto), thereby reducing an EMI.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method for a plasma display panel driving apparatus, the driving apparatus including an odd-numbered scanning electrode driver for driving odd-numbered scanning electrodes on a plasma display panel, an odd-numbered common sustaining electrode driver for driving odd-numbered common sustaining electrodes on the plasma display panel to generate a discharge between the respective odd-numbered common sustaining electrodes and the corresponding odd-numbered scanning electrodes, an even-numbered scanning electrode driver for driving even-numbered scanning electrodes on the plasma display panel, an even-numbered common sustaining electrode driver for driving even-numbered common sustaining electrodes on the plasma display panel to generate a discharge between the respective even-numbered common sustaining electrodes and the respective even-numbered scanning electrodes, and a data driver for driving data electrodes on the plasma display panel, the method comprising:

driving the even-numbered scanning electrode driver and the even-numbered common sustaining electrode driver to generate sustaining discharges in even-numbered electrode lines while the odd-numbered scanning electrode driver and the odd-numbered common sustaining electrode driver perform an addressing operation, wherein the addressing operation allows cells in odd-numbered electrode lines to be selected for display; and driving the odd-numbered scanning electrode driver and the odd-numbered common sustaining electrode driver to generating the sustaining discharges in the odd-numbered electrode lines when the even-numbered scanning electrode driver performs the addressing operation together with the data electrode driver, wherein the addressing operation allows cells in the even-numbered electrode lines to be selected for display.

2. The method claimed in claim 1, wherein the odd-numbered scanning electrode driver and the odd-numbered common sustaining electrode driver are opposite to the even-numbered scanning electrode driver and the even-numbered common sustaining electrode driver with respect to a center of the plasma display panel, respectively, thereby allowing voltages applied to the odd-numbered electrode lines and the even-numbered electrode lines to be opposite to each other in phase during the sustaining discharging.

* * * * *